US006800243B2

(12) United States Patent
Tetyukhin et al.

(10) Patent No.: US 6,800,243 B2
(45) Date of Patent: Oct. 5, 2004

(54) TITANIUM ALLOY AND METHOD FOR HEAT TREATMENT OF LARGE-SIZED SEMIFINISHED MATERIALS OF SAID ALLOY

(75) Inventors: Vladislav Valentinovich Tetyukhin, Moscow (RU); Jury Ivanovich Zakharov, Moscow (RU); Igor Vasilievich Levin, Sverdlovskoy obl. (RU)

(73) Assignee: VSMPO, Sverdlovsk (RU)

( * ) Notice: Subject to any disclaimer, the term of this patent is extended or adjusted under 35 U.S.C. 154(b) by 138 days.

(21) Appl. No.: 10/275,093

(22) PCT Filed: Feb. 5, 2001

(86) PCT No.: PCT/RU01/00045

§ 371 (c)(1),
(2), (4) Date: Nov. 1, 2002

(87) PCT Pub. No.: WO02/06544

PCT Pub. Date: Jan. 24, 2001

(65) Prior Publication Data

US 2003/0116233 A1 Jun. 26, 2003

(30) Foreign Application Priority Data

Jul. 19, 2000 (RU) ..... 2000119247

(51) Int. Cl.[7] ..... C22C 14/00
(52) U.S. Cl. ..... 420/420; 148/421; 420/421

(58) Field of Search ..... 148/421; 420/420, 420/421

(56) References Cited

U.S. PATENT DOCUMENTS

| | | | |
|---|---|---|---|
| 4,067,734 | A | 1/1978 | Curtis et al. |
| 4,889,170 | A | 12/1989 | Mae et al. |
| 5,332,545 | A | 7/1994 | Love |

FOREIGN PATENT DOCUMENTS

| | | | |
|---|---|---|---|
| RU | 2122040 | C1 | 11/1998 |
| SU | 555161 | A | 5/1977 |
| SU | 912771 | A | 3/1982 |

*Primary Examiner*—George Wyszomierski
*Assistant Examiner*—Janelle Morillo
(74) *Attorney, Agent, or Firm*—Garrison & Associates PS; David L. Garrison

(57) ABSTRACT

The inventive titanium alloy comprises, expressed in mass %: aluminium 4.0–6.0; vanadium 4.5–5.0; molybdenum 4.5–5.0; chromium 2.0–3.6; ferrum 0.2–0.5; the rest being titanium. An equivalent molybdenum content is determined as corresponding to $Mo_{equiv.} \geqq 13.8$. The total aluminum and zirconium content does not exceed 7.2. The inventive method for heat treatment consists in heating to $t_{\beta<>\alpha+\beta}$−(30–70)° C., conditioning during 2–5 hrs. at that temperature, air or water cooling and age-hardening at a temperature ranging from 540° C. to 600° C. during 8–16 hrs. Said alloy has a high volumetric deformability and is used for manufacturing massive large-sized forged and pressed pieces having a high strength level, satisfactory characteristics of plasticity and fracture toughness.

4 Claims, No Drawings

TITANIUM ALLOY AND METHOD FOR HEAT TREATMENT OF LARGE-SIZED SEMIFINISHED MATERIALS OF SAID ALLOY

FIELD OF THE INVENTION

The inventions relates to non-ferrous metallurgy, and more particularly, to production of modern titanium alloys preferably used for manufacturing of large-sized forgings, stampings, fasteners and other parts for aeronautical engineering.

PRIOR STATE OF ART

Titanium-based alloy of the following composition, % by mass, is known:

| | |
|---|---|
| aluminum | 4.0–6.3 |
| vanadium | 4.5–5.9 |
| molybdenum | 4.5–5.9 |
| chromium | 2.0–3.6 |
| iron | 0.2–0.8 |
| zirconium | 0.01–0.08 |
| carbon | 0.01–0.25 |
| oxygen | 0.03–0.25 |
| titanium | the balance |

(RF Patent # 2122040, C22C 14/00, 1998) as the prototype.

The said alloy possesses a good combination of high strength and plasticity of large-sized parts up to 150–200 mm thick, water or air hardened. The alloy is easily hot deformed and is welded by argon-arc and electron-bean welding.

The disadvantage of the alloy is an insufficient level of strength of massive large-sized parts more than 150–200 mm thick, air hardened.

The method of heat treatment of large-sized semifinished items made of two-phase titanium alloys comprising preheating up to the temperature 7–50° C. higher than the polymorphic transformation temperature, holding for 0.15–3 hours, cooling to the two-phase region temperature, 20–80° C. lower than the polymorphic transformation temperature, holding for 0.15–3 hours, hardening and aging is known (USSR Inventor's Certificate # 912771. C22F, Jan. 18, 1982) as the prototype.

The disadvantage of the method is an insufficient level of strength of massive large-sized parts more than 150–200 mm thick.

DISCLOSURE OF THE INVENTION

An object of the claimed titanium-based alloy and method of heat treatment of large-sized semifinished items of the said alloy is to attain higher level of strength of massive large-sized parts 15–200 mm in excess thick.

The integral technical result attained in the process of realization of the claimed group of inventions is the regulation of optimal combination of α- and β-stabilizing alloying elements in the produced semifinished item.

The said technical result is attained by the fact that titanium-based alloy containing aluminum, vanadium, molybdenum, chromium, iron, zirconium, oxygen and titanium additionally contains nitrogen, with the following distribution of components, % by mass:

| | |
|---|---|
| aluminum | 4.0–6.0 |
| vanadium | 4.5–6.0 |
| molybdenum | 4.5–6.0 |
| chromium | 2.0–3.6 |
| iron | 0.2–0.5 |
| zirconium | 0.7–2.0 |
| oxygen | no more than 0.2 |
| nitrogen | no more than 0.05 |
| titanium | the balance |

while the molybdenum equivalent $Mo_{eq} \geqq 13.8$.

According to the invention the molybdenum equivalent is determined by the following relation:

$$Mo_{eq} = \frac{\%\ Mo}{1} + \frac{\%\ V}{1.5} + \frac{\%\ Cr}{0.6} + \frac{\%\ Fe}{0.4} \quad (1)$$

Besides, total content of aluminum and zirconium does not exceed 7.2 (2)

The said technical result is attained also by the fact that in the method of heat treatment of large-sized semifinished items of the claimed titanium-based alloy comprising heating, holding at the temperature lower than the polymorphic transformation temperature, cooling and aging, in accordance with the invention heating is performed directly to $t_{\beta \longleftrightarrow \alpha+\beta}$−(30–70)° C., holding at the said temperature is performed for 2–5 hours, and aging is performed at 540–600° C. for 8–16 hours. Cooling is performed in air or water.

Mostly β-phase is responsible for high strength of the alloy due to the sufficiently wide range of β-stabilizers (V, Mo, Cr, Fe), their considerable amount and efficiency of their ability to affect the possibility of maintaining the meta-stable phase condition during retarded cooling (for instance, in air) of massive cross-section stampings. Though β-phase is the leading one in the process of the alloy strengthening, it is possible to enhance the tendency to strength increasing only at the expense of strength increase of α-phase, normal fraction of which for this alloy is 60–70%. To do this, alloying of α-phase with α-stabilizing zirconium was intensified; the latter forms a wide range of solid solutions with α-titanium, is relatively close to it in terms of melting temperature and density, it increases corrosion resistance and in quantity up to 1.5–2.0% softly increases the alloy strength, and practically does not decrease its plasticity and cracking resistance.

Due to the regulation of β-stabilizers in the form of molybdenum equivalent according to relation (1) with establishing of its minimal value, increasing of the zirconium content and regulation of the α-stabilizers content in accordance with relation (2), in combination with optimization of processing to solid solution parameters, including heating and holding at the temperature lower than the polymorphic transformation temperature, massive articles of the claimed alloy after air (or water) hardening from the processing to solid solution temperature, have after the aging step higher level of strength with satisfactory plasticity and destruction viscosity characteristics.

This application meets the requirement of unity of invention as the method of heat treatment is intended for manufacture of semifinished items of the claimed alloy.

EMBODIMENTS OF THE INVENTION

To study the alloy characteristics test 430 mm diameter ingots of the following average composition were manufactured:

TABLE 1

| | Chemical alloy | | | | | | | | | $Mo_{eq}$ |
|---|---|---|---|---|---|---|---|---|---|---|
| Alloy | Al | Mo | V | Cr | Zr | Fe | Ti | $\beta \leftrightarrow \alpha + \beta$ | t° C. | (Al + Zr) |
| 1 | 5.2 | 5.0 | 5.1 | 3.0 | 0.01 | 0.4 | the balance | 840 | 14.4 | 5.21 |
| 2 | 5.1 | 4.9 | 5.3 | 3.1 | 1.2 | 0.35 | the balance | 845 | 14.5 | 6.3 |

The ingots were forged in series in β, α+β, β, α+β-regions with finish deformation in α+β-region in the range of 45–50% per 250 mm diameter cylindrical billet.

Further the forgings were subjected to the following heat treatment:

a) Processing to solid solution: heating at 790° C., holding for 3 hours, cooling in air.

b) Aging: heating at 560° C., holding for 8 hours, cooling in air.

Mechanical properties of the forgings (averaged data in per unit direction) are given in Table 2.

TABLE 2

| Alloy | $\sigma_{0.2}$(VTS), MPa (KSi) | $\sigma_B$(UTS), MPa (Ksi) | δ(A) % | ψ(Ra), % | $K_{1C}$ MPa $\sqrt{M}$ (KSi $\sqrt{in}$) |
|---|---|---|---|---|---|
| 1 | 1213 (176) | 1304 (189) | 12 | 36 | 53.2 (48.4) |
| 2 | 1255 (182) | 1350 (195.6) | 10.5 | 33 | 51.5 (46.85) |

The test results show that the claimed alloy and the method of heat treatment of semifinished items of it permit to ensure more secure and stable increase of strength characteristics of massive parts while maintaining satisfactory plasticity characteristics.

Commercial Practicability

The claimed group of inventions is intended for any articles (rods, forgings, plates, etc.) but particularly for massive forgings and stampings (with in excess 150–200 mm side dimension or cross-section diameter, wherein it is required to ensure high level of strength.

What is claimed is:

1. Titanium-based alloy containing aluminum, vanadium, molybdenum, chromium, iron, zirconium, oxygen and titanium which distinction is that it additionally contains nitrogen with the following proportion of components, % by mass:

| | |
|---|---|
| aluminum | 4.0–6.0 |
| vanadium | 4.5–6.0 |
| molybdenum | 4.5–6.0 |
| chromium | 2.0–3.6 |
| iron | 0.2–0.5 |
| zirconium | 0.7–2.0 |
| oxygen | no more than 0.2 |
| nitrogen | no more than 0.05 |
| titanium | the balance |

while the molybdenum equivalent $Mo_{eq} \geqq 13.8$.

2. Alloy as claimed in claim 1 which distinction is that the molybdenum equivalent is determined by the following relation:

$$Mo_{eq} = \frac{\%\ Mo}{1} + \frac{\%\ V}{1.5} + \frac{\%\ Cr}{0.6} + \frac{\%\ Fe}{0.4}$$

3. Alloy as claimed in claims 1 which distinction is that total content of aluminum and zirconium does not exceed 7.2.

4. Alloy as claimed in claim 2 which distinction is that the total content of aluminum and zirconium does not exceed 7.2.

* * * * *